United States Patent [19]

Lofkrantz et al.

[11] 4,141,784

[45] Feb. 27, 1979

[54] METHOD AND APPARATUS FOR CONTROLLING WOOD CHIP DIGESTER LEVEL

[75] Inventors: John E. E. Lofkrantz, Coquitlam; Andrew B. Isner, Powell River, both of Canada

[73] Assignee: MacMillan Bloedel Limited, Vancouver, Canada

[21] Appl. No.: 792,575

[22] Filed: May 2, 1977

[51] Int. Cl.[2] ..... D21C 7/06; D21C 7/08; D21C 7/12

[52] U.S. Cl. ..... 162/17; 162/49; 162/52; 162/238; 162/243; 162/246; 162/262; 162/263; 364/110; 364/116; 364/509; 364/551; 364/562

[58] Field of Search ..... 162/17, 19, 263, 49, 162/238, DIG. 10, 243, 246, 52, 262; 222/64; 235/150.1, 92 DN, 92 FL; 364/509, 110, 116, 562, 551; 214/17 A

[56] References Cited

U.S. PATENT DOCUMENTS

| | | | |
|---|---|---|---|
| 2,938,824 | 5/1960 | Richter | 162/238 |
| 3,617,717 | 11/1971 | Smith | 162/238 |
| 3,650,890 | 3/1972 | Kamio | 162/238 |
| 3,746,843 | 7/1973 | Wesner | 235/92 DN |
| 3,898,124 | 8/1975 | Olson | 162/238 |

FOREIGN PATENT DOCUMENTS

| | | | |
|---|---|---|---|
| 2400308 | 7/1974 | Fed. Rep. of Germany | 162/49 |

OTHER PUBLICATIONS

Fuchs et al., "Advances in Computer Control of Kamyr Continuous Digesters," Tappi; vol. 59, No. 2, Feb. 1976, presented Sep. 9-1975, (pp. 96-99).

Fuchs et al., "Blow Flow Control of Continuous Digesters," Tappi, vol. 54, No. 3; Mar. 1971, (pp. 368-371).

Fox; "Control Strategy;" Tappi, May 1966; vol. 49, No. 5, (pp. 87A-89A), May 1966.

*Primary Examiner*—S. Leon Bashore
*Assistant Examiner*—Steve Alvo
*Attorney, Agent, or Firm*—Larson, Taylor and Hinds

[57] ABSTRACT

A control system and a process is disclosed for a continuous wood chip downflow digestion system. The system maintains chip level in the top of the digester and maintains a consistency in the ratio of chips to liquor in the blowline thus allowing the system to run without constant operator attention. The system comprises a means for measuring the level of chips at the top of the digester and producing a level index over a predetermined time. This level index is compared with a preset level index and an error signal produced which operates a speed control means within preset limits for a rotating scraper feeding into the blowline. There is also provided a means for measuring the feed rate of chips to the digester, and a summating means for adding a predetermined ratio setpoint for the feed rate of chips against a flow in the blowline, to an integral of the error signal above or below a preset range to produce a summated ratio. The blowline flow is then controlled within preset limits to proximate the summated ratio to the feed rate of chips.

7 Claims, 2 Drawing Figures

METHOD AND APPARATUS FOR CONTROLLING WOOD CHIP DIGESTER LEVEL

This invention relates to the production of wood chips and more particularly to a novel level control system and method for a continuous downflow digester. Although the term wood chips is used throughout the specification, this term could include any type of lignocellulosic material that can be processed in a continuous downflow digester.

Pulp production using Kamyr Digesters is extensive throughout the world today and is perhaps one of the best known pulp production methods. The process is a continuous cooking process with hot washing and comprises presteaming wood chips, followed by pressure impregnation, cooking, in-digester countercurrent washing and final wash.

In many conventional continuous digesters, the level of the wood chips in top of the digester is measured to ensure uniform chip flow. One device for measuring chip level is known as a torque tube. This device operates on the principle of measuring the change in torque caused by the increasing or decreasing frequency of impact of wood chips on a small fan blade. This change in frequency produces the change in torque which indicates the chip level in the top of the digester. The device operates a series of lights which gives an indication of whether the chip level is low, medium or high. Another sensor device measures the current consumed (the motor load or motor amps) on the motor which drives the top separator. This device also gives an indication of chip level within the digester. Both these devices give an indication to an operator so that he can make the necessary adjustments to maintain a constant level of chips in the digester. One problem that sometimes occurs with continuous digesters is that the feed rate is uneven. Chips are fed into the digester through a chip meter which has pockets therein and whereas the volume of each pocket in the chip meter is the same, the chip sizes and shapes vary considerably thus the quantity of chips can vary from one pocket to another on the meter. In the traditional manner of level control, the operator maintains the level by manipulating the blowline flow and/or the bottom scraper speed with occasional changes in extraction flow. The success or failure of the operator's preceeding moves are indicated to him by a level sensor, such as one of the herein described. This method of control, if it is to operate to its best efficiency, requires constant operator attention. Other demands on the operator's time make this attention impossible, thus the control of the chip level deteriorates with the result that the chip level is either high or low for extended periods of time. This sometimes results in undesirable effects such as off-quality stock or in extreme cases a production slow down. In the case of changes in wood chip supply, there is a demand for a rebalancing of flows. If this rebalancing is not done the level tends to become high or low. Production rate changes also produce upsets in the level control which must be compensated for otherwise serious process operating changes can occur. As a consequence the operating point of the blowline flow is indexed to the production rate or the chip meter rpm in order to keep wood chips in and pulp stock out in balance.

It is an object of the present invention to attempt to maintain digester chip level within predetermined limits in the digester. It is a further object to attempt to maintain a rough consistency in the ratio of chips to liquor in the blowline and it is another object to make the first two objects fit together responsive to the chip feed rate.

To attain these objects, there is provided a control system which monitors the level of wood chips in the top of the digester, is aware of the chip feeding rate to the chip meter, and the setpoints for the ratio of blowline flow to chip feed rate. To attain constant level in the digester, the speed of the bottom scraper may be varied as well as the flow in the blowline.

The present invention provides in a continuous wood chips downflow digestion system wherein wood chips are fed to the top of the digester and wood pulp is discharged from the bottom of the digester by a rotating scraper feeding into a blowline having a flow control valve therein, the improvement of a control system comprising, means for measuring actual level of wood chips at the top of the digester, means for producing an actual level index from a plurality of individual readings of the actual level over a predetermined time interval, comparison means for comparing the actual level index with a preset level index and producing an error signal proportional to a deviation of the difference between the actual level index and the preset index, speed control means on the rotating scraper operable within preset limits in accordance with the error signal, measuring means for feed rate of chips to the digester, summating means for adding a predetermined ratio setpoint for the feed rate of chips against a flow in the blowline, to an integral of the error signal above or below a preset range to produce a summated ratio, and means for controlling the flow control valve with preset limits such that the blowline flow proximates the summated ratio to the feed rate of chips.

In drawings which illustrate embodiments of the invention,

Figure 1:
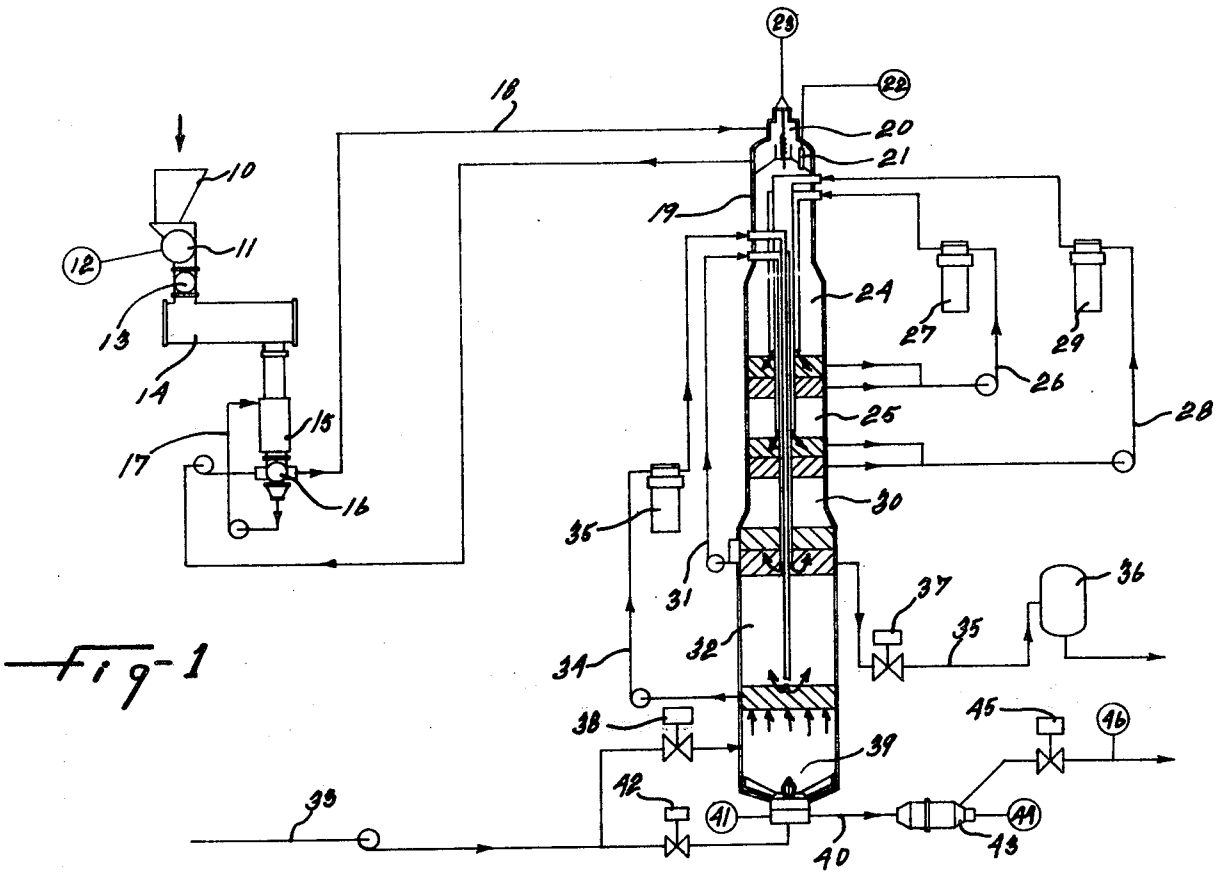
FIG. 1 is a schematic diagram of a continuous wood chip downflow digestion system of the Kamyr type.

Referring now to FIG. 1, a continuous wood chip downflow digestion system of the Kamyr type is shown where wood chips after magnetic separation of iron particles enter a hopper 10 and pass through a chip meter 11. The production rate is set by varying the chip meter speed. A production rate indicator 12 produces an indication of the speed of the chip meter 11 which is used in the control system of the present invention. From the chip meter 11, the chips pass through a low pressure feeder 13 into a steaming vessel 14. The steam pressure is kept at 15 to 20 lbs./sq. inch and after presteaming the chips enter a chip chute 15 passing from there to a high pressure feeder 16. The chips are flushed into the high pressure feeder 16 by means of a chute circulator 17. As the feeder motor 16 turns the chips enter the digester high pressure system 18 and are conveyed to the top of the digester 19 where chips are separated from the conveying liquor by the top separator 20. A torque tube 21 is positioned in the top of the digester 19 and produces a level indication 22 which is used with the control system of the present invention. As a backup to the torque tube 21, a motor amp indicator 23 for the top separator 20 provides another indication of chip level within the digester.

Chips and cooking liquor move down through a first impregnation zone 24 in the digester 19. The chips then enter a two-stage heating zone 25 where the temperature is raised in two stages. A first cooking circulation system 26 having a first heater 27 therein and a second heating circulation system 28 having a second heater 29 therein. After heating the chips and liquor pass through the digestion stage 30 where wash liquor is circulated through the chips in a wash liquor circulation system 31 to provide a quench of the cooking reaction and thereby provide a definite termination to the digestion phase. The chips then continue to pass downwards into the high heat washing zone 32 where wash liquor is introduced in a wash liquor system 33 and flows upwards concurrently to the chip flow. Elevated temperatures of 125° to 135° C. are controlled in this zone 32 by an auxiliary wash liquor circulation 34 having a heater 35 therein. Black liquor is extracted from the top of the high heat washing zone 32 by a black liquor extraction system 35 through a flash tank 36. The flow of black liquor extracted through the system 35 is controlled by a control valve 37 so that outlet flow is equal to the sum of the undiluted spend liquor within the high heat washing zone 32 and the displacement of wash liquor 33 passing through control valve 38.

A bottom scraper 39 provides discharge from the digester 19 into a blowline 40. The bottom scraper 39 has a variable speed controlled motor providing a speed control system 41. Wash liquor 33 may be provided through a control valve 42 to the scraper 39 as it enters the blowline 40. The blowline 40 passes through a blow unit 43 which has a consistency meter to give a consistency indication 44, that is to say the ratio of pulp to liquid in the blowline. The blowline flow valve 45 controls the flow through the blowline 40 and a magnetic flow meter 46 gives an indication of the total flow.

Figure 2:
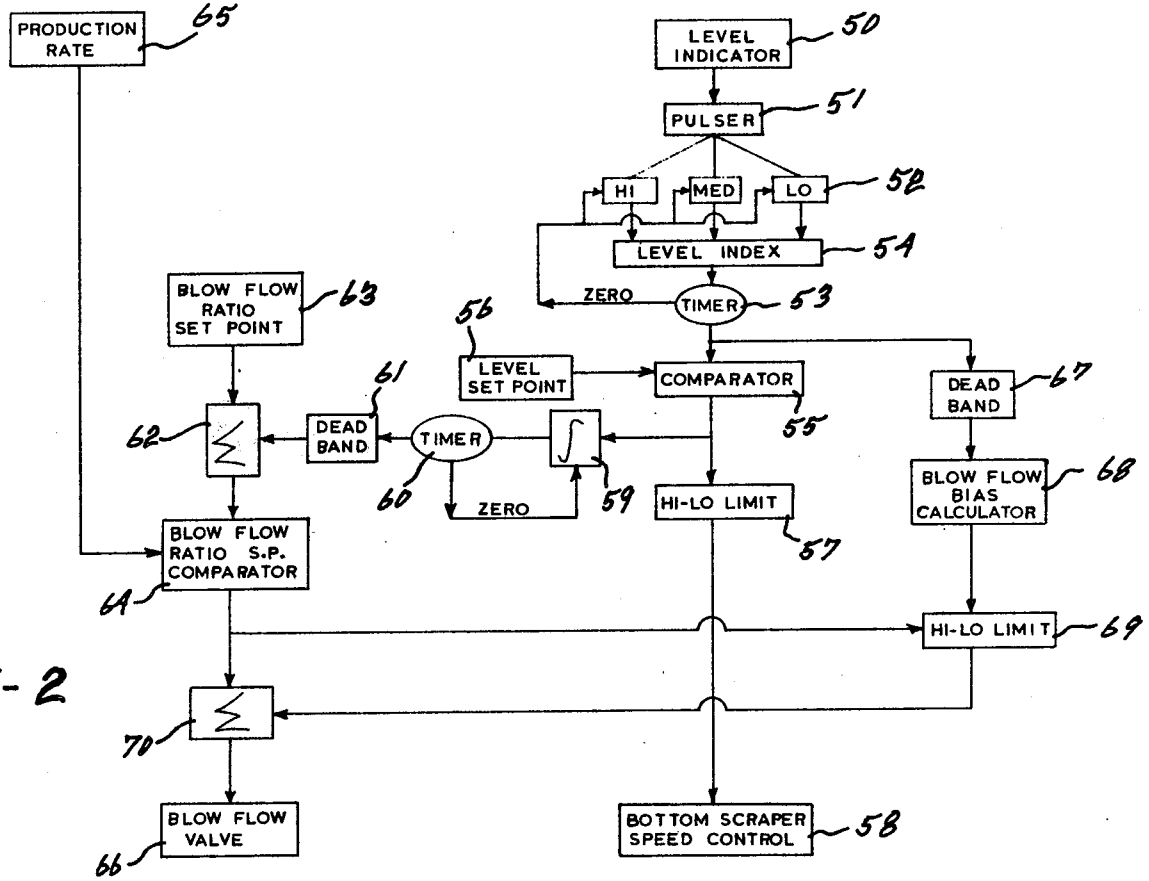
FIG. 2 is a block diagram of a control system according to the present invention for monitoring a continuous wood chip downflow digestion system.

Referring now to FIG. 2 the level indicator 50 is either the level indication 22 from the torque tube 21 or the top separator motor amp indicator 23 as shown in FIG. 1. The signal from the level indicator 50 passes through a pulser 51 to produce pulses which are gated into high, medium or low individual counters 52. After a preset time set by a timer 53, the number of pulses recorded on each counter 52 are summed up and an actual level index 54 is calculated. The actual level index goes from 0 to 100%. If all the pulses for one interval are recorded in the high counter, the actual level index will be 100%. If all the pulses are recorded in the low counter, the actual level index will be 0%. When the timer 53 completes a time interval then the pulse counters 52 are zeroed and the calculations start over again to give another actual level index.

The signal from the actual level index 54 is compared at a comparator 55 with a preset level index 56 initially set by the operator. This preset level index 56 is ideally 50% however may be in the range of, for example, 40 to 60%. A difference between the preset level index 56 and the actual level index 54 causes the comparator to produce an error signal which after passing through a hi-lo limit 57 is fed to the bottom scraper speed control 58. A change in the bottom scraper speed is made which corresponds directly to the error between the preset level index and the actual level index. In one embodiment the hi-lo limit is set so that a high of above 8 rpm and a low of below 6 rpm will not be passed to the bottom scraper. These hi-lo limits are functions of individual digestors, the scraper is only used to control the level of chips within the digester within certain limits as it cannot feed extra chips or remove extra chips from the system.

A signal representing the error between the preset level index and the actual level index is sent from comparator 55 to an integrator 59 which integrates the error signal over a predetermined time interval. This time interval is determined by the timer 60. When the interval has expired, the integration is set back to zero and the calculation repeats itself. Also, when the interval has expired, a signal is passed through a deadband 61 to a summator 62. If the signal from the timer 60 is within a predetermined range or band, it is blanked out by the deadband 61 and no signal is passed to the summator 62. If, however, the signal is outside the deadband range then it is passed through to the summator 62. In one embodiment the deadband is plus or minus 2% thus if the integrated signal is above or below 2% it is passed to the summator 62.

A blow flow ratio setpoint 63 is determined by computer calculation at the moment of control transfer from operator settings of the output of the blowline and the chip meter. The blow flow ratio is the ratio of the output from the blowline 40 as seen in FIG. 1 compared to the production rate which is shown on the production rate indicator 12 from the chip meter 11 as seen in FIG. 1. The blow flow ratio setpoint 63 is further updated by the summator 62 with the integrated signal from the level index to give a modified signal which is then fed to the blow flow ratio setpoint comparator 64. When the signal from the deadband 61 to the summator 62 is zero, the signal from the blow flow ratio setpoint 63 is the calculated value dependent on operator settings of the output of the blowline and chip meter. The transfer of control is considered "bumpless" inasmuch as there are no abrupt changes in the flows when transfer occurs. If the blow flow ratio setpoint 63 is changed during operation, then the blow flow control systems, including the bias control, produces a built-in sluggish response thus giving a slow smooth change in flow.

The blow flow ratio setpoint comparator 64 compares a modified blow flow ratio setpoint from the summator 62 with the production rate 65 which is indicated on the production rate indicator 12 from the chip meter 11 as shown in FIG. 1. The signal produced from the blow flow ratio setpoint comparator 64 represents the required rate of flow in the blowline and is fed to the blow flow valve 66 which sets this rate of flow. The comparator 64 assures that the production rate 65 and the flow rate in the blowline complies to the blow flow ratio setpoint as modified by the summator 62. This condition is not followed when a bias control system is incorporated.

In a preferred embodiment, there is a blow flow bias to modify the rate of flow in the blowline and take into account extreme differences in level. The signal from the level index 54 which represents the true level index between 0 and 100 is fed through a deadband 67 to a blow flow bias calculator 68. It has been determined that there is a direct relationship between the actual level and the calculated blow flow ratio which comes from the blow flow ratio setpoint and the summation of the actual level index integrated signal. This direct relationship is referred to as the bias calculation and is used to fine tune the position of the blow flow valve. The deadband 67 is set so that if the signal from the actual level index is within a certain range it is not passed to the blow flow bias calculator 68. The signal from the blow flow bias calculator 68 is passed through a hi-lo limit 69 which is preferably 12% but depends on the particular digester. The primary purpose of this limit is to prevent overblowing and thus losing the consistency in the bottom of the digester and in effect blowing no pulp, just liquor. The hi-lo limit 69 is affected by the signal from the blow flow ratio setpoint comparator 64. Thus when a change occurs in the blow flow ratio setpoint then automatically the hi-lo limit 69 for the blow flow bias calculation would also have to change. The final bias signal is summated at a summator 70 with the signal passing to the blow flow valve 66 from the blow flow ratio setpoint comparator 64. This summator 70 sends a signal representing the desired flow in the blowline biased to take into account extreme variations of the chip level in the digester. Thus the blow flow valve 66 is set to give the desired flow in the blowline called for by the level control program.

Whereas it is not disclosed in the present application other systems may be included with the present system such as adjusting the extraction flow by a preset amount once the wash zone consistency goes outside a preset range for a preset time in order to bring the consistency back within the preset range. In order to perform this step, the consistency of the pulp and liquor in the lower portion of the digester must be known.

While only a preferred embodiment of the present invention has been described, it is to be understood that the invention is not intended to be restricted solely thereto, but is intended to include all modifications thereof which would be apparent to one skilled in the art and which comes within the spirit and scope of the present invention.

The embodiments of the invention in which an exclusive property or privilege is claimed are defined as follows:

1. In a continuous wood chip downflow digestion system wherein wood chips are fed to the top of the digester and wood pulp is discharged from the bottom of the digester by a rotating scraper feeding into a blowline having a flow control valve therein, the improvement of a control system comprising, means for measuring actual level of wood chips at the top of the digester, means for producing an actual level index from a plurality of individual readings of the actual level over a predetermined time interval, comparison means for comparing the actual level index with a preset level index and producing an error signal proportional to a deviation of the difference between the actual level index and the preset level index, speed control means on the rotating scraper operable within preset limits for adjusting the discharge of wood pulp from the bottom of the digester in accordance with the error signal, means for integrating the error signal over a predetermined time and for modifying a predetermined blow flow ratio of the feed rate of chips to the flow in the blowline in accordance with said integrated error signal, means for measuring the feed rate of chips to the digester, comparator means for comparing the modified blow flow ratio with the measured chip feed rate and for producing an output signal representative of the required blowline flow to proximate the modified blow flow ratio, means for controlling the flow control valve in the blowline in accordance with the output signal and wherein the chip level in the digester is maintained at a preset level and the flow in the blow line is controlled to obtain the modified blow flow ratio.

2. The control system according to claim 1 wherein the means for measuring actual level and means for producing an actual level index includes a pulser producing a series of evenly distributed pulses over the predetermined time period, a high level counter, medium level counter and low level counter, means to gate each pulse into one of the counters representing a high, medium or low actual level of wood chips at the top of the digester, and an actual level index means to sum up the number of pulses gated to each of the counters and produce a signal representing the actual level index over the predetermined time interval.

3. The control system according to claim 1 wherein the means for measuring the actual level of wood chips at the top of the digester is a torque tube indicator.

4. The control system according to claim 1 wherein the means for measuring the actual level of wood chips at the top of the digester measures the current consumed by an electric motor turning a rotating separator in the top of the digester.

5. The control system according to claim 1 including means for producing a blow flow bias signal when the actual level index is above or below a preset range, and means for adding the modified blow flow ratio to the blow flow bias signal to produce a second output signal to use in the means for controlling the flow control valve.

6. The control system according to claim 5 wherein the blow flow bias signal has a hi-lo limit which varies as the modified blow flow ratio varies.

7. In the process of continuously digesting wood chips in a downflow digestion system wherein wood chips are fed to the top of a digester and wood pulp is discharged from the bottom of the digester by a rotating scraper feeding into a blowline having a flow control valve therein, the improvement comprising the steps of, measuring actual level of wood chips at the top of the digester, producing an actual level index from a plurality of individual readings of the actual level over a predetermined time interval, comparing the actual level index with a preset level index and producing an error signal proportional to a deviation of the difference between the actual level index and the preset level index, adjusting rotational speed of the rotating scraper within preset limits in accordance with the error signal, integrating the error signal over a predetermined time, modifying a predetermined blow flow ratio of the feed rate of chips to the flow in the flowline in accordance with said integrated error signal, measuring the feed rate of chips to the digester, comparing the modified blow flow ratio with the measured chip feed rate, producing an output signal representative of the required blowline flow to proximate the modified blow flow ratio, controlling the flow control valve in the blowline in accordance with the output signal and wherein the chip level in the digester is maintained at a preset level and the flow in the blow line is controlled to obtain the modified blow flow ratio.

* * * * *